US005419000A

United States Patent [19]

Amato et al.

[11] Patent Number: 5,419,000

[45] Date of Patent: May 30, 1995

[54] BRUSH WITH REMOVABLE SCRAPER APPARATUS

[76] Inventors: Frank Amato, 6497 W. 11th La., Hialeah, Fla. 33012; Frank Avanzini, 1560 Nottingham Dr., Winter Park, Fla. 32792

[21] Appl. No.: 239,612

[22] Filed: May 9, 1994

[51] Int. Cl.[6] ..... A47L 13/12

[52] U.S. Cl. ..... 15/111; 15/236.01; 30/169; 30/344; D4/118; D32/48; D32/49

[58] Field of Search ..... 15/111, 236.01, 236.05; 29/525.1; 30/169, 337, 344; D4/118; D32/46, 48, 49

[56] References Cited

U.S. PATENT DOCUMENTS

| | | | |
|---|---|---|---|
| 122,186 | 12/1871 | Michaels et al. | 15/111 |
| D. 308,140 | 5/1990 | Klamm | D4/118 |
| 718,534 | 1/1903 | Shedd | D32/49 |
| 856,168 | 6/1907 | Lykken | 15/111 |
| 925,259 | 6/1909 | Ziegler | 30/169 |
| 1,310,007 | 7/1919 | Dumas | 15/111 |
| 1,421,478 | 7/1922 | Hope | 15/111 |
| 2,359,408 | 10/1944 | Disse | 15/236.01 |
| 3,250,000 | 5/1966 | Schumann | 15/236.05 |
| 3,398,419 | 8/1968 | Carlos | 15/111 |
| 3,995,345 | 12/1976 | Larsson | 15/105 |
| 4,041,564 | 8/1977 | Schlicher | 15/111 |
| 4,365,380 | 12/1982 | Fassler | 15/111 |
| 4,741,064 | 5/1988 | Riegert et al. | 15/111 |
| 4,916,773 | 4/1990 | McCoy . | |

FOREIGN PATENT DOCUMENTS

| | | | |
|---|---|---|---|
| 543877 | 9/1922 | France | 30/169 |
| 20520 | of 1899 | United Kingdom | 15/111 |

*Primary Examiner*—Mark Spisich
*Attorney, Agent, or Firm*—Frank L. Kubler

[57] ABSTRACT

A scraper and brush apparatus includes a brush having a number of bristles, a bristle retaining structure, and a brush body portion having a body portion surface having an engaging recess, a scraper assembly including a scraper plate having a scraping edge and having an engaging projection and a middle plate portion extending between the scraping edge and the engaging projection, the scraper plate being removably secured to the brush body portion with a fastener passing through the scraper plate middle plate portion and into the brush body portion and with the engaging projection fitted into the engaging recess. The engaging recess preferably includes a slot cut into the brush body portion and the engaging projection preferably includes a flange adapted to fit into the groove. The brush body portion preferably includes a handle portion and the recess is preferably located in the handle portion. The fastener preferably includes a bolt having first and second bolt ends and having a head at the first bolt end and threads at the second bolt end, and includes a nut removably screwed over the second bolt end onto the threads. The nut is preferably a wing nut. A method of changing a scraper element on the scraper and brush apparatus includes the steps of placing the scraper element against the brush body portion so that the engaging projection fits into the engaging recess, securing the scraper element to the brush body portion with the fastener.

5 Claims, 2 Drawing Sheets

BRUSH WITH REMOVABLE SCRAPER APPARATUS

BACKGROUND OF THE INVENTION

1. Field of the Invention

The present invention relates generally to the field of tools for painting and scraping. More specifically, the present invention relates to a combined paint brush and scraper apparatus with a set of changeable scrapers for various scraping jobs and requirements. The apparatus includes a paint brush or other brush preferably having an elongate handle portion with a bristle retaining rack connected at a first handle end which retains a plurality of bristles. A removable scraper assembly is provided at a second handle end. The removable scraper assembly preferably includes a transverse slot recessed into the second handle end, a scraper plate having a distal end including a scraping edge and having an anchoring end including an engaging flange. A scraper plate middle plate portion extends between the distal end and anchoring end and includes a fastener receiving opening. Means are provided for removably fastening the scraper plate to the second handle end including a fastener such as a screw passing through the fastener receiving opening and through a substantially diametric bore in the second handle end. The fastener is removably secured such as with a wing nut, with the engaging flange fitted into the transverse slot in the second handle end to secure the scraper plate against rotation about the fastener relative to the handle portion. The apparatus preferably includes an assorted set of scraper plates of varying shapes, sizes and scraper edge orientations for a variety of scraping jobs.

2. Description of the Prior Art

There have long been brushes having attached scraper assemblies. One such prior brush is that of Fassler, U.S. Pat. No. 4,365,380, issued on Dec. 28, 1982. Fassler discloses a brush-like cleaning tool for cleaning grills and other structures having rod-like members. The tool includes a tool body having wire-like brush bristles projecting outwardly from a bottom surface and a scraper element attached the body front end. The scraping element is a generally cylindrical scraper member having a generally circular scraping edge to surround rod-like members to be cleaned. The scraping element may be secured by threaded fasteners converging from three sides of the element. A problem with Fassler is that the scraping element configuration is suited only to cleaning rod-like structures, and no alternative elements are provided for other jobs. Another problem with Fassler is that one must undo three fasteners to remove the element for cleaning or replacement.

Klamm, U.S. Pat. Des. No. 308,140, issued on May 29, 1990, reveals a combined brush and possibly removable scraper apparatus. The brush includes an elongate handle portion with a distal end fitted with a row of bristles and a scraper plate secured with one fastener. A problem with Klamm is that the scraper plate is apparently free to rotate about the fastener during use, making use awkward and unreliable. Another problem is that no variety of plate configurations is offered, limiting the types of jobs for which Klamm is suited.

Carlos, U.S. Pat. No. 3,398,419, issued on Aug. 27, 1968, teaches a combined scraper and brush cleaning tool for cleaning T-slots in machine tools or other apparatus. The brush is constructed of sheet metal and includes a tubular handle portion formed at one end into a transversely extending cleaner or scoop. A problem with Carlos is that the scoop shape of the scraper has limited use and cannot be altered. Another problem is that the scraper cannot be removed and replaced if it becomes worn or broken.

Riegert et al., U.S. Pat. No. 4,741,064, issued on May 3, 1988, discloses a combination paint brush and paint can opener and scraper. Riegert includes a paint brush that has a handle with an axially oriented slot in its extreme end opposite the bristle end. Part of a blade fits tightly within the slot, and the other part extends outwardly to pry up paint can lids and to remove loose paint from limited access locations. Problems with Riegert are that the blade is apparently not removable and replaceable, and the blade shape is suited for only narrowly limited uses.

Larsson, U.S. Pat. No. 3,995,345, issued Dec. 7, 1976, reveals a cleaning tool in the form of a brush having an elongate handle with bristles and rubber scraping element at one end. A scraping element mounting flange extends from the bristle rack portion and two screws with wing nuts extend through the mounting flange, through the scraping element and a securing plate. A problem with Larsson is that the protruding scraping element assembly could obstruct and otherwise interfere with the use of the bristle portion. Another problem is that two fasteners must be undone to remove and replace the scraping element.

Schlicher, U.S. Pat. No. 4,041,564, issued on Aug. 16, 1977, reveals a combination scraper and brush with extensible handle. Schlicher includes an elongate handle provided with a scraper member at one end and a brush assembly that is telescopically received in the handle. The scraper member is held by a transversely positioned holder which is integrally molded with the handle and which extends above the handle. A problem with Schlicher is that the scraper member is apparently not removable, and no alternative scraper member configurations are offered for varying job requirements even if it were removable.

McCoy, U.S. Pat. No. 4,916,773, issued on Apr. 17, 1990, reveals a paint brush having an aperatured block retaining a plurality of bristles. A frame is secured to the block on one end and secured to a handle on its other end so that a cavity is defined between the block and the handle for storing bristle cleaning fluid. A problem with McCoy is that no scraping means is apparently provided.

It is thus an object of the present invention to provide a brush and scraper apparatus which includes a scraper plate having a scraping edge and being removable, so that a worn or damaged plate can be replaced while the brush is retained.

It is another object of the present invention to provide such an apparatus which includes several scraper plates of various shapes, sizes and scraping edge orientations for securing to the brush to meet various scraping Job requirements.

It is still another object of the present invention to provide such an apparatus where the scraper plates are securely attached to the brush and yet are quickly and easily removed and replaced with other such scraper plates.

It is finally an object of the present invention to provide such an apparatus which is simple, durable, easy to use and inexpensive to produce.

SUMMARY OF THE INVENTION

The present invention accomplishes the above-stated objectives, as well as others, as may be determined by a fair reading and interpretation of the entire specification.

A scraper and brush apparatus is provided which includes a brush having a number of bristles, a bristle retaining structure, and a brush body portion having a body portion surface having an engaging recess, a scraper assembly including a scraper plate having a scraping edge and having an engaging projection and a middle plate portion extending between the scraping edge and the engaging projection, the scraper plate being removably secured to the brush body portion with a fastener passing through the scraper plate middle plate portion and into the brush body portion and with the engaging projection fitted into the engaging recess. The engaging recess preferably includes a slot cut into the brush body portion and the engaging projection preferably includes a flange adapted to fit into the groove. The brush body portion preferably includes a handle portion and the recess is preferably located in the handle portion. The fastener preferably includes a bolt having first and second bolt ends and having a head at the first bolt end and threads at the second bolt end, and includes a nut removably screwed over the second bolt end onto the threads. The nut is preferably a wing nut.

The brush alternatively includes a number of bristles, a bristle retaining structure, and a brush body portion having a body portion surface including an engaging projection, and a scraper assembly including a scraper plate having a scraping edge and having an engaging recess and a middle plate portion extending between the scraping edge and the engaging recess, the scraper plate being removably secured to the brush body portion with a fastener passing through the scraper plate middle plate portion and into the brush body portion and with the engaging projection fitted into the engaging recess.

A method is provided of changing a scraper element on a scraper and brush apparatus, where the scraper and brush apparatus includes a brush having a number of bristles, a bristle retaining structure, and a brush body portion having a body portion surface including an engaging recess, and a scraper assembly including a scraper element having a scraping edge and having an engaging projection and using a middle portion extending between the scraping edge and the engaging projection, removably secured to the brush body portion with a fastener passing through the scraper element middle portion and into the brush body portion, with the engaging projection fitted into the engaging recess, including the steps of placing the scraper element against the brush body portion so that the engaging projection fits into the engaging recess, securing the scraper element to the brush body portion with the fastener.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
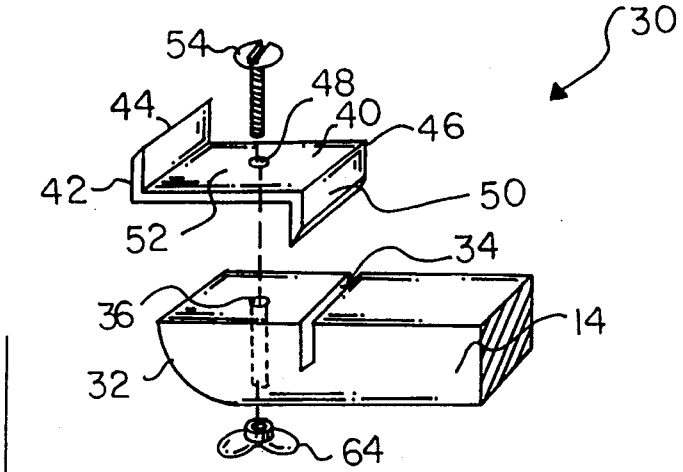
FIG. 1 is a top view of the first preferred embodiment of the inventive brush and scraper apparatus with a scraper plate attached.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
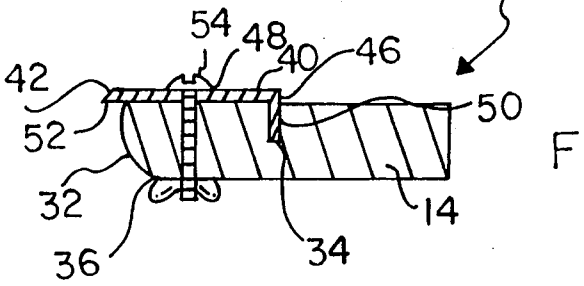
FIG. 2 is a cross-sectional side view of the proximal end of the brush handle showing the relationship between the scraper plate, the fastener, the handle and the wing nut.
Figure 3:
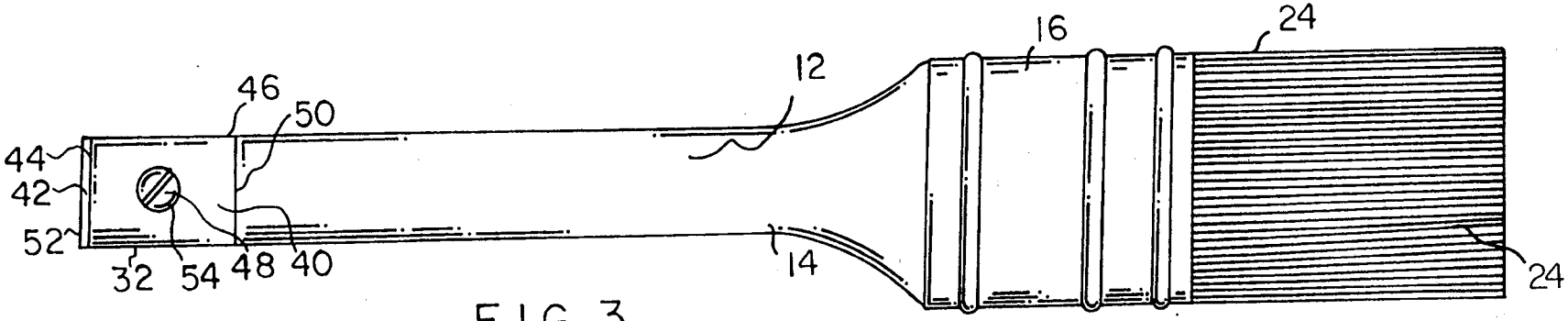
FIG. 3 is a broken-away exploded view of the proximal end of the brush handle with the scraper plate attached.
Figure 7:
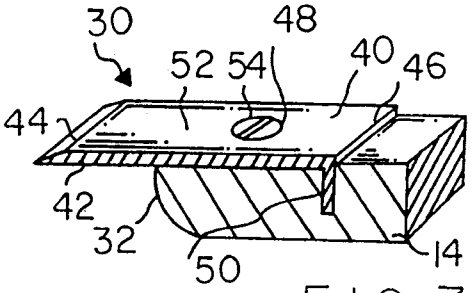
FIG. 7 is a broken-away perspective view of the proximal end of the brush handle with another type of scraper plate attached.
Figure 8:
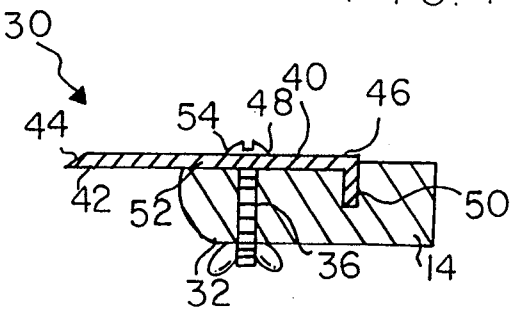
FIG. 8 is a cross-sectional side view of the proximal end of the brush handle fitted with the scraper plate shown in FIG. 7.
Figure 9:
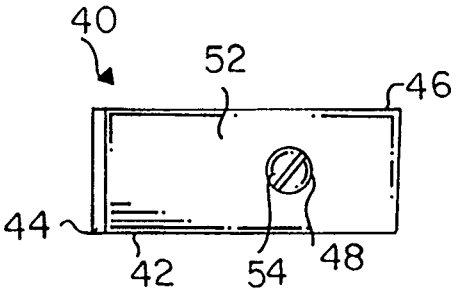
FIG. 9 is a top view of the scraper plate shown in FIG. 7 with the fastening screw inserted.
Figure 4:
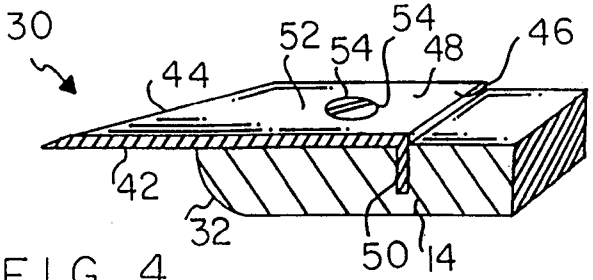
FIG. 4 is a broken-away perspective view of the proximal end of the brush handle with another type of scraper plate attached.
Figure 5:
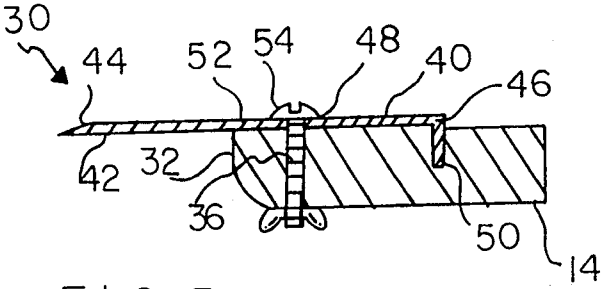
FIG. 5 is a cross-sectional side view of the proximal end of the brush handle fitted with the scraper plate shown in FIG. 4.
Figure 6:
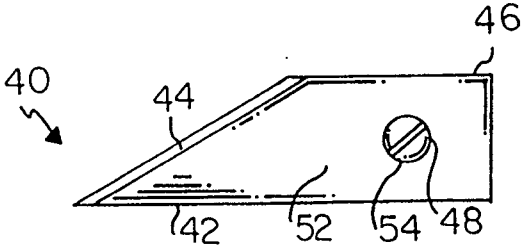
FIG. 6 is a top view of the scraper plate shown in FIG. 4 with the fastening screw inserted.

Referring to FIGS. 1–9, a combined paint brush and scraper apparatus 10 is disclosed. Apparatus 10 includes a brush 12 having an elongate handle portion 14 with a conventional bristle retaining rack 16 at a first handle end 22 retaining a plurality of bristles 24. See FIGS. 1–3. A removable scraper assembly 30 is provided at a second handle end 32, which includes a transverse receiving slot or other receiving opening 34 recessed into second handle end 32, and a diametric bore 36 through end 32, and further includes a scraper plate 40. Scraper plate 40 has a distal end 42 which includes a scraping edge 44, and has an anchoring end 46 which includes an engaging flange or other projecting element 50 sized to fit snugly into opening 34. A middle plate portion 52 connects distal end 42 and anchoring end 46, and includes a fastener receiving opening 48. Means are provided for removably fastening the scraper plate 40 to second handle end 32. These fastening means include a fastener 54 such as a pan head screw passing laterally through fastener receiving opening 48 and through diametric bore 36 in second handle end 32. Securing plate 40 is further secured by engaging flange 50 which is fitted into transverse slot 34 in second handle end 32. Screw 54 is preferably removably secured with a wing nut 64. Flange 50 secures the scraper plate against rotation about screw 54 relative to elongate handle portion 14. Apparatus 10 preferably includes an assorted set of scraper plates 40 of varying shapes, sizes and scraper edge orientations for a variety of scraping jobs. See FIGS. 2–9.

Each scraper plate 40 may be secured in the same manner to rack 16 or some other location on the body of the brush. Brush 12 may be a paint brush, or any other type of brush for jobs where a scraper function would be desirable. The inventive use of a single removable fastener 54 such as a screw or bolt and a receiving opening 34 and protruding element 50 secures plate 40 against rotation and yet requires the operation of only one fastener when changing plates 40. This saves time and effort, and is particularly important for the professional making continued use of apparatus 10. Scraper plate 40 is preferably covered with a protective sheath or sleeve which may be formed of a suitable plastic or other material, when not in use, to prevent injury.

Method

In practicing the invention, the following method may be used. A scraper plate 40 is placed against second handle end 32 such that protruding element 50 fits into receiving opening 34. Then scraper plate 40 is secured to second handle end 32 with fastener 54. A scraper plate 40 is removed by unfastening fastener 54 and lifting scraper plate 40 away from second handle end 32 so that protruding element 50 slides out of opening 34.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A scraper and brush apparatus, comprising:

a brush having bristle retaining means, a plurality of bristles affixed to and extending from said bristle retaining means, and a brush body portion extending from said bristle retaining means and having a body portion surface having an engaging recess, scraper means including a scraper plate having an elongated scraping edge and having an engaging projection and a middle plate portion extending between said scraping edge and said engaging projection, said scraper plate being removably secured to said brush body portion with a fastener passing through said scraper plate middle plate portion and into said brush body portion and with said engaging projection fitted into said engaging recess, wherein said engaging recess comprises an elongated slot cut into said brush body portion and said engaging protection comprises an elongated flange substantially perpendicular to the middle plate portion and extending along an edge thereof adapted to fit snugly into and frictionally engage said slot.

2. The apparatus of claim 1, wherein said brush body portion comprises a handle portion and said slot is in said handle portion.

3. The apparatus of claim 1, wherein said fastener comprises a bolt having first and second bolt ends and having a head at said first bolt end and threads at said second bolt end, and comprising a nut removably screwed over said second bolt end onto said threads.

4. The apparatus of claim 3, wherein said nut is a wing nut.

5. A scraper and brush apparatus, comprising:

a brush having bristle retaining means, a plurality of bristles affixed to and extending from said bristle retaining means, and a brush body portion affixed to and extending from said bristle retaining means and having a body portion surface having an elongated engaging slot, scraper means including a single scraper plate bent into a substantially S-shaped cross-section and including a middle plate portion extending between and connecting with two elongated flange portions at opposite edges of the middle plate portion, each said flange portion being substantially perpendicular to said middle plate portion and extending in mutually opposite directions from said middle plate portion, each said flange portion having a flange portion free edge, each said free edge tapering in thickness to function as a scraping edge, one said flange portion being fitted into and frictionally engaging said engaging slot, means for removably securing said scraper means to said body portion, such that when one said flange portion free edge becomes dull from scraping use, said scraper means may be removed from said body and reversed in position relative to said body and said flange portion dull from scraping use may be inserted into said engaging slot, such that said scraper means may be secured to said body portion with either of said flange portions fitting into said slot and the remaining flange portion protruding to present its free edge to function as a scraper edge.

* * * * *